US006579615B1

(12) United States Patent
Sugimaru et al.

(10) Patent No.: US 6,579,615 B1
(45) Date of Patent: Jun. 17, 2003

(54) PLATED STEEL WIRE WITH CORROSION RESISTANCE AND EXCELLENT WORKABILITY, AND PROCESS FOR ITS MANUFACTURE

(75) Inventors: Satoshi Sugimaru, Kimitsu (JP); Satoru Tanaka, Kimitsu (JP); Seiki Nishida, Kimitsu (JP); Akira Takahashi, Kimitsu (JP); Atsuhiko Yoshie, Futtsu (JP); Kazumi Nishimura, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/869,115

(22) PCT Filed: Oct. 25, 2000

(86) PCT No.: PCT/JP00/07470

§ 371 (c)(1),
(2), (4) Date: Jul. 24, 2001

(87) PCT Pub. No.: WO01/31079

PCT Pub. Date: May 3, 2001

(30) Foreign Application Priority Data

Oct. 25, 1999 (JP) ..... 11/302685

(51) Int. Cl.[7] ..... B32B 15/01; B05D 3/00

(52) U.S. Cl. ..... 428/359; 148/533; 427/398.3; 427/398.4; 427/406; 427/432; 427/433; 427/436; 428/926; 428/939

(58) Field of Search ..... 428/659, 926, 428/939; 148/533; 427/398.3, 398.4, 406, 432, 433, 436

(56) References Cited

FOREIGN PATENT DOCUMENTS

| | | | | |
|---|---|---|---|---|
| EP | 0 657 560 A1 | | 1/1995 | |
| EP | 0 905 270 A2 | | 3/1999 | |
| JP | 59-173253 | | 10/1984 | |
| JP | 63-262451 | | 10/1988 | |
| JP | 64-8702 | | 2/1989 | |
| JP | 7-207421 | | 8/1995 | |
| JP | 07207421 A | * | 8/1995 | ..... C23C/2/06 |
| JP | 10-226865 | | 8/1998 | |
| JP | 10-265926 | | 10/1998 | |
| WO | WO 98/26103 | | 6/1998 | |

OTHER PUBLICATIONS

Patent Abstracts of Japan, vol. 013, No. 105 (C–575), Mar. 13, 1989, JP 63–277733.

Patent Abstracts of Japan, vol. 011, No. 024 (C399), Jan. 23, 1987, JP 61–195960.

Patent Abstracts of Japan, vol. 1999, No. 12, Oct. 29, 1999, JP 11–199956.

Patent Abstracts of Japan, vol. 010, No. 373 (C–391), Dec. 12, 1986, JP 61–166961.

Patent Abstracts of Japan, vol. 2000, No. 12, Jan. 3, 2001, JP 2000–239818.

Supplementary European Search Report, EP 00970071, May 8, 2002.

Journal of Materials Processing Technology 55, pp. 134–139, 1995, (no month given).

* cited by examiner

*Primary Examiner*—Robert R. Koehler
(74) *Attorney, Agent, or Firm*—Kenyon & Kenyon

(57) ABSTRACT

This invention provides a plated steel wire with high corrosion resistance and excellent workability, wherein the average composition of the plating alloy in the plated steel wire comprises, in terms of weight percentage, Al: 4–20%, Mg: 0.8–5%, and if necessary one or more from among Si: ≦2%, Na: 0.001–0.1% and Ti: 0.01–0.1%, with the remainder Zn, and an Fe—Zn alloy layer of no greater than 20 μm thickness is present at the plating-base metal interface; it is produced by coating a steel wire with a molten zinc plating composed mainly of zinc as the first stage and then.coating it with a molten zinc alloy plating with the aforementioned average composition as the second stage. The maximum plating bath immersion time is 20 seconds, and the part of the plated steel wire drawn out from the plating bath is purged with nitrogen gas.

8 Claims, 2 Drawing Sheets

PLATED STEEL WIRE WITH CORROSION RESISTANCE AND EXCELLENT WORKABILITY, AND PROCESS FOR ITS MANUFACTURE

TECHNICAL FIELD

The present invention relates to a plated steel wire that exhibits high corrosion resistance suitable for steel wires for gabion, fishnets and the like that are used in areas exposed to the outdoors.

BACKGROUND ART

Commonly used plated steel wires include zinc-plated steel wires and the more highly corrosion-resistant zinc-aluminum alloy-plated steel wires. Zinc-aluminum alloy-plated steel wires are generally produced by first subjecting steel wires to a cleaning treatment such as washing and degreasing and then to a flux treatment, followed by either hot-dip plating of mainly zinc as the first stage and then hot-dip plating in a Zn—Al alloy bath containing 10% Al as the second stage, or else direct hot-dip plating in a Zn—Al alloy bath containing 10% Al, and finally vertically drawing the wire out from the plating bath, cooling and winding.

Such zinc-aluminum alloy-plated steel wires have satisfactory corrosion resistance, but even higher corrosion resistance can be achieved by methods that increase the plating thickness. One method of guaranteeing the prescribed plating thickness is a method of raising the conveying speed (flux) of the steel wire to rapidly draw out the steel wire from the plating bath, and increasing the amount of plating alloy adhering to the steel wire by increasing the viscosity of the hot-dip plating alloy.

In this method, however, the high conveying speed tends to produce an irregular plating thickness in the cross-section perpendicular to the lengthwise direction of the plated steel wire, and limits therefore exist for such plating equipment. As a result, existing plating equipment has not provided sufficient corrosion resistance by zinc plating or by hot-dip plating with Zn—Al alloys, and this constitutes a problem in that expectations cannot be completely satisfied given current expectations regarding a longer usable life for plated steel wires.

In order to combat this problem, Japanese Unexamined Patent Publication HEI No. 10-226865 proposes a Zn—Al—Mg alloy plating composition with high corrosion resistance imparted by Mg added to the plating bath, but the plating method based on this plating composition assumes thin layering for steel sheets, and when the method is applied to thick plated steel wires typically used for gabion and the like, the problem of plating layer cracking occurs when working the plated steel wires.

Japanese Unexamined Patent Publication HEI No. 7-207421 describes a method in which a Zn—Al—Mg alloy plating is formed to a greater thickness, but when the method is directly applied to plating of steel wires, the Fe—Zn alloy layer becomes thick, leading to problems such as cracking or peeling of the alloy layer when working the plated steel wires.

DISCLOSURE OF THE INVENTION

In light of the problems described above, it is an object of the present invention to provide a plated steel wire coated with a molten zinc alloy plating such that the plated steel wire exhibits excellent corrosion resistance and excellent workability that can avoid cracking or peeling of the plating layer and/or the plating alloy layer during working of the plated steel wire, as well as to provide a process for its manufacture.

The present invention has been completed as a result of much diligent research, by the present inventors, on a means of solving the aforementioned problems, and its gist is as follows.

(1) A plated steel wire with high corrosion resistance and excellent workability, the plated steel wire being characterized in that the average composition of the plating alloy contains, in terms of weight percentage, Al: 4–20%, Mg: 0.8–5% and the remainder Zn, and in that an Fe—Zn alloy layer of no greater than 20 $\mu$m thickness is present at the plating-base metal interface.

(2) A plated steel wire with high corrosion resistance and excellent workability according to (1) above, characterized in that the average composition of the plating alloy also contains, in terms of weight percentage, Si: $\leqq$2%.

(3) A plated steel wire with high corrosion resistance and excellent workability according to (1) or (2) above, characterized in that the average composition of the plating alloy also contains, in terms of weight percentage, Na: 0.001–0.1%.

(4) A plated steel wire with high corrosion resistance and excellent workability according to any one of (1) to (3) above, characterized in that the average composition of the plating alloy also contains, in terms of weight percentage, Ti: 0.01–0.1%.

(5) A plated steel wire with high corrosion resistance and excellent workability according to any one of (1) to (4) above, characterized in that the Fe—Zn alloy layer contains Al: $\geqq$4%, Mg: $\geqq$1%.

(6) A plated steel wire with high corrosion resistance and excellent workability according to any one of (1) to (5) above, characterized in that the structure of the plating alloy layer on the outer side of the Fe—Zn alloy layer includes an $\alpha$ phase composed mainly of Al—Zn, a $\beta$ phase comprising a Zn monophase or an Mg—Zn alloy phase, and a Zn/Al/Zn—Mg three component eutectic phase.

(7) A plated steel wire with high corrosion resistance and excellent workability according to any one of (1) to (6) above, characterized in that the structure of the plating alloy layer on the outer side of the Fe—Zn alloy layer includes an $\alpha$ phase composed mainly of Al—Zn, a $\beta$ phase comprising a Zn monophase or an Mg—Zn alloy phase, and a Zn/Al/Zn—Mg three component eutectic phase, and the volume fraction of the $\beta$ phase is no greater than 20%.

(8) A plated steel wire with high corrosion resistance and excellent workability according to any one of (1) to (5) above, characterized in that the structure Dirt of the plating alloy layer on the outer side of the Fe—Zn alloy layer is a dendritic structure.

(9) A plated steel wire with high corrosion resistance and excellent workability according to any one of (1) to (5) above, characterized in that the structure of the plating alloy layer on the outer side of the Fe—Zn alloy layer is a granular crystal structure.

(10) A plated steel wire with high corrosion resistance and excellent workability according to any one of (1) to (9) above, characterized in that the component composition of the plated steel wire comprises, in terms of weight percentage, C: 0.02–0.25%, Si: $\leqq$1%, Mn: $\leqq$0.6%, P: $\leqq$0.04% and S: $\leqq$0.04%.

(11) A process for the manufacture of a plated steel wire with high corrosion resistance and excellent workability, characterized in that the process for manufacture of a plated steel wire comprises coating a steel wire with a molten zinc plating composed mainly of zinc as the first stage, and then coating it with a molten zinc alloy plating having the average composition specified in any one of (1) to (4) above as the second stage.

(12) A process for manufacture of a plated steel. wire with high corrosion resistance and excellent workability according to (11) above, characterized in that the molten zinc plating as the first stage is a molten zinc plating comprising, in terms of weight percentage, Al: ≦3% and Mg: ≦0.5%.

(13) A process for the manufacture of a plated steel wire with high corrosion resistance and excellent workability according to (11) or (12) above, characterized in that in the steps of coating with a molten zinc plating as the first stage and coating with a molten zinc alloy plating as the second stage, the part of the plated steel wire drawn out from the plating bath is purged with nitrogen gas to prevent oxidation of the bath surface and the plated steel wire.

(14) A process for the manufacture of a plated steel wire with high corrosion resistance and excellent workability according to any one of (11) to (13) above, characterized in that the molten zinc plating as the first stage is coated for a maximum plating bath immersion time of 20 seconds, and the molten zinc alloy plating as the second stage is coated for a maximum plating bath immersion time of 20 seconds.

(15) A process for the manufacture of a plated steel wire with high corrosion resistance and excellent workability according to any one of (11) to (14) above, characterized in that in the steps of coating with a molten zinc plating as the first stage and coating with a molten zinc alloy plating as the second stage, the wire is directly cooled by a water spray, steam or a water flow immediately after the plated steel wire is drawn out from the plating alloy, to harden the plating alloy.

(16) A process for the manufacture of a plated steel wire with high corrosion resistance and excellent workability according to any one of (11) to (15) above, characterized in that in the steps of coating with a molten zinc plating as the first stage and coating with a molten zinc alloy plating as the second stage, the initial cooling temperature for cooling of the plated steel wire is in a range from the melting point of the plating alloy to 20° C. above the melting point.

(17) A process for the manufacture of a plated steel wire with high corrosion resistance and excellent workability according to any one of (11) to (16) above, characterized in that the component composition of the plated steel wire comprises, in terms of weight percentage, C: 0.02–0.25%, Si: ≦1%, Mn: ≦0.6%, P: ≦0.04% and S: ≦0.04%.

BEST MODE FOR CARRYING OUT THE INVENTION

The plated steel wire of the invention will first bee explained in detail.

The plating alloy in the plated steel wire of the invention has an average composition, in terms of weight percentage, of Al: 4–20%, Mg: 0.8–5% and the remainder Zn.

Al has an effect of increasing the corrosion resistance, but when added at less than 4% it provides no effect and the antioxidizing effect of Mg in the plating bath cannot be obtained. When Al is added at greater than 20%, the resulting plating alloy is hard and fragile, which makes it impossible to accomplish working. The range for Al in the plating alloy is therefore 4–20%. When plating a steel wire, this range is preferably 9–14% in order to achieve greater thickness. A stable plating layer can be obtained when the Al content is within this range.

Mg produces a uniform plating corrosion product, and corrosion products containing Mg act to prevent further corrosion. Mg therefore has an effect of improving the corrosion resistance of the plating alloy. When added at less than 0.8%, however, no effect of improved corrosion resistance can be achieved. On the other hand, if added at more than 5%, the plating bath surface tends to undergo oxidation and generate large amounts of dross, thus hampering operation.

Figure 1:
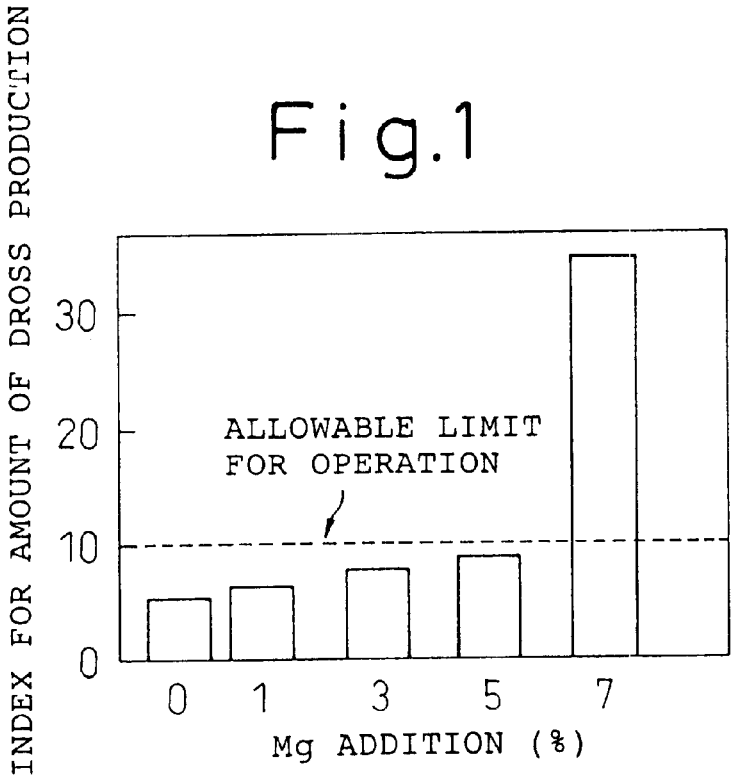
FIG. 1 is a graph showing the relationship between Mg addition and an index of the amount of dross production generated on the plating bath surface, for a case in which Mg is added to a Zn-10% Al alloy.

FIG. 1 is a graph showing the relationship between Mg addition and an index of the amount of dross production generated on the plating bath surface, for a case in which Mg is added to a Zn-10% Al alloy. The conditions are the same other than the amount of Mg added. When the amount of added Mg exceeds 5%, a larger amount of dross is produced, thus increasing the frequency at which the dross must be removed and hampering operation. Based on this result, the range for the amount of Mg has been determined to be 0.8–5%, in order to ensure both corrosion resistance and low dross production.

An alloy layer composed mainly of Fe—Zn is formed at the plating-ground iron interface, and when this alloy layer is thick the alloy layer may crack, tending to result in cracking at the interface between the alloy layer and the base metal, or at the interface between the alloy layer and the plating.

Figure 2:
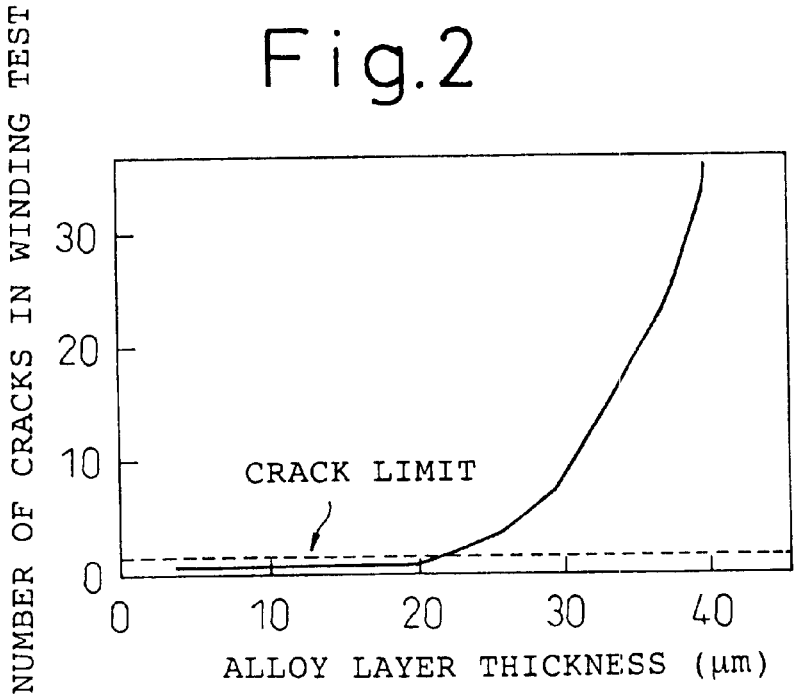
FIG. 2 is a graph showing the relationship between the alloy layer thickness and the number of cracks in a winding test, for a case of Zn-10% Al-1% Mg alloy plating.

FIG. 2 is a graph showing the relationship between the alloy layer thickness and the number of cracks in a winding test, for a case of Zn-10% Al-1% Mg alloy plating. This graph shows that cracking increases when the thickness of the plating alloy layer is greater than 20 $\mu$m, such that the plating cannot withstand practical use. Thus, since 20 $\mu$m is the upper limit for thickness of a plating alloy layer that does not impair the workability, the thickness of the Fe—Zn alloy layer is limited to 20 $\mu$m. The alloy layer is preferably of a lower thickness since its corrosion resistance is inferior to conventional plating layers, and it is even more preferably limited to no greater than 10 $\mu$m.

It is effective to add Si to the plating layer in order to further increase the corrosion resistance. Addition of Si is more effective with a greater amount of Al addition. In the plated steel wire of the invention, the maximum amount of Si that gives an effect is 2% with an Al addition of 20% of the maximum, and therefore the range for Si is limited to no greater than 2%.

Dross will be produced on the plating bath surface when performing the plating, and it is effective to add a trace amount of Na to inhibit this dross production. Inhibiting the dross production can provide the effect of an improved plating surface and a greater plating alloy yield. A trace amount of Na is therefore added to the plating alloy, but if it exceeds 0.1% the Na will undergo oxidation, and therefore the range for the amount of Na is limited to 0.001–0.1%. Addition of Ti also has the effect of inhibiting dross production, and the range for effective addition of Ti is 0.01–0.1%.

In addition to Si, Na and Ti mentioned above, addition of antimony, misch metals and the like also provides the effect of improving the plating surface condition.

In the plated steel wire described to this point, the corrosion resistance is improved by including Al: ≧4% and Mg: ≧1% in the Fe—Zn alloy layer present at the plating-ground iron interface. Since no effect of improved corrosion resistance is obtained when the Al in the aforementioned alloy layer is less than 4%, the range for the Al content is 4% or greater.

Also, the presence of Mg produces a uniform corrosion product and improves the corrosion resistance, and since no effect can be obtained at less than 1%, the range for the Mg content is 1% or greater.

Because the plated steel wire of the invention contains Al and Mg as components, cooling after the plating can form an α phase composed mainly of Al—Zn, a β phase comprising a Zn monophase or an Mg—Zn alloy phase, and a Zn/Al/Zn—Mg three component eutectic phase, copresent in the plating alloy layer on the outer side of the alloy layer present at the plating-ground iron interface.

Of these, the presence of the Zn/Al/Zn—Mg three component eutectic phase provides a uniform corrosion product and an effect of inhibiting further corrosion due to the uniform corrosion product. The β phase has inferior corrosion resistance compared to the other phases, and thus tends to undergo local corrosion. If the volume fraction of the β phase is over 20% the corrosion resistance tends to be lower, and therefore its volume fraction is limited to 20%.

When the plated steel wire is drastically cooled by water cooling, the structure of the plating alloy layer on the outer side of the alloy layer composed mainly of Fe—Zn present at the plating-ground iron interface can be converted to a dendritic structure. When a dendritic structure is formed, each of the structures produced in the plating become intricate, and the corrosion resistance is thus improved.

When the plated steel wire is gently cooled by water cooling, the structure of the plating alloy layer on the outer side of the alloy layer composed mainly of Fe—Zn present at the plating-ground iron interface can be converted to a granular crystal structure. When a granular crystal structure is formed, each of the structures produced in the plating become granular, and this inhibits propagation of cracks to thus improve the workability.

The process used for manufacture of the plated steel wire of the invention is a two-stage plating process. By coating a molten zinc plating composed mainly of zinc to form an Fe—Zn alloy layer as the first stage and then coating a molten zinc alloy plating with the average composition specified according to the invention as the second stage, it is possible to efficiently obtain a plated steel wire according to the invention. The molten zinc used for the molten zinc plating of the first stage may be a molten zinc alloy comprising, in terms of weight percentage, Al: ≦3% and Mg: ≦0.5%. When an Fe—Zn alloy layer is obtained by molten zinc plating in the first stage, inclusion of Al and Mg in the Fe—Zn alloy layer has the effect of allowing easier diffusion of Al and Mg in the plating alloy layer.

In the process for manufacture of the plated steel wire of the invention, enhanced workability can be achieved if the part of the plated steel wire drawn out from the plating bath is purged with nitrogen gas to prevent oxidation of the bath surface and the plated steel wire. When oxides are produced on the plating surface after plating or when produced oxides adhere to the bath surface, the plating sometimes suffers cracking around the oxides as nuclei during working of the plated steel wire. For this reason, it is important to prevent oxidation of the drawn out portion.

Figure 3:
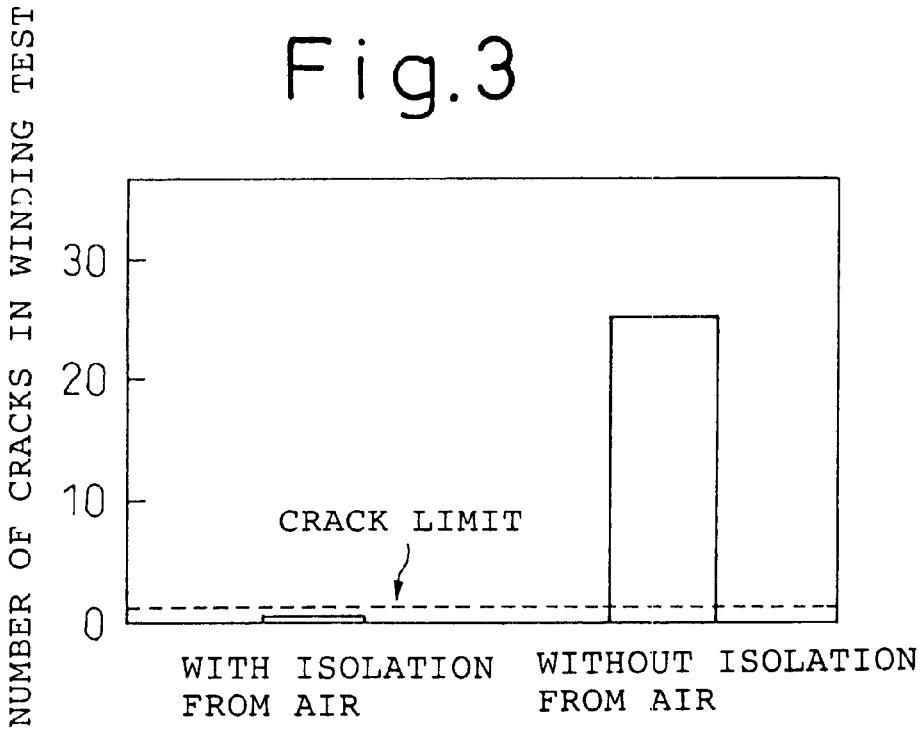
FIG. 3 is a graph comparing surface cracking (number of cracks) in a winding test with and without isolation from air, for a plated steel wire having a Zn-10% Al-3% Mg plating alloy composition.

FIG. 3 is a graph comparing surface cracking (number of cracks) in a winding test with and without isolation from air, for a plated steel wire having a Zn-10% Al-3% Mg plating alloy composition. Without isolation from air, the number of cracks produced on the surface exceeds the maximum allowable number. While an inert gas such as argon or helium can be used instead of nitrogen in order to prevent oxidation, nitrogen is superior in terms of cost.

When a plated steel wire according to the invention is obtained by the two-stage process, suitable growth of the plating alloy can only be achieved if the molten zinc plating composed mainly of zinc as the first stage is coated for a maximum plating bath immersion time of 20 seconds, and the molten zinc alloy plating as the second stage is coated for a maximum plating bath immersion time of 20 seconds. When the plating is carried out for a longer time, the thickness of the alloy layer is increased beyond 20 μm; consequently, the molten plating composed mainly of zinc as the first stage is coated for a maximum plating bath immersion time of 20 seconds, and the molten zinc alloy plating as the second stage is coated for a maximum plating bath immersion time of 20 seconds.

Figure 4:
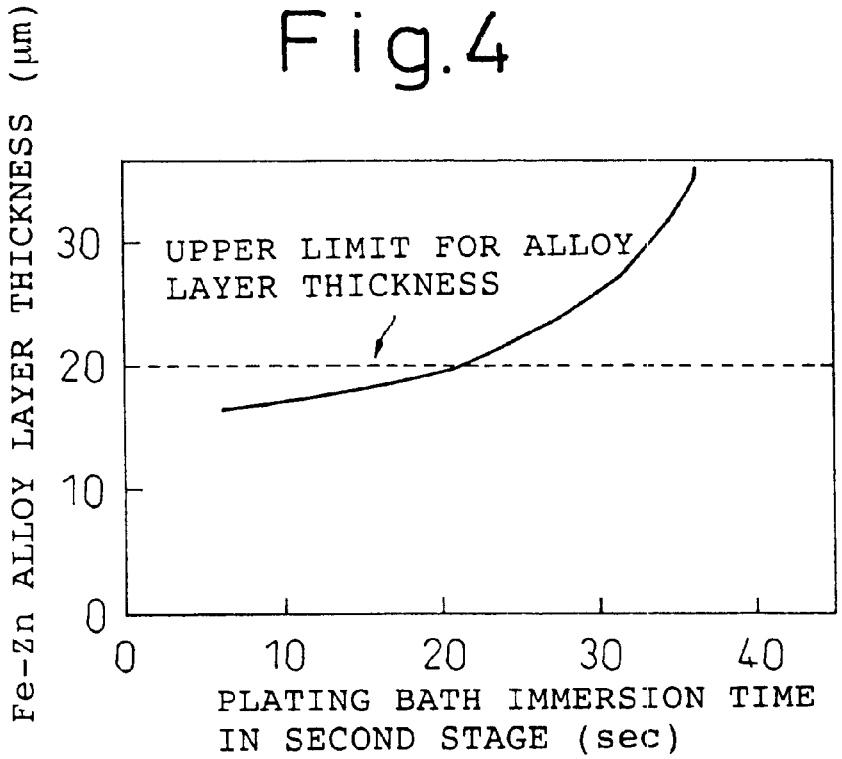
FIG. 4 is a graph showing the relationship between the plating bath immersion time and the Fe—Zn alloy layer thickness.

FIG. 4 is a graph showing the relationship between the plating bath immersion time and the Fe—Zn alloy layer thickness, for a case in which molten zinc plating (immersion time: 20 seconds) has been carried out in the first stage to form an Fe—Zn alloy layer with a thickness of 15 μm, and the plated wire is coated with a molten zinc alloy plating using a Zn-10% Al-1% Mg bath composition (second stage). This graph shows that in the molten zinc alloy plating of the second stage, the thickness of the alloy layer undergoes little growth with a plating alloy bath immersion time of up to 20 seconds, and the alloy layer thickness is no greater than 20 μm.

If cooling is carried out rapidly while the plating alloy of the plated steel wire is in a molten state after plating it is possible to harden each phase without growth, thus resulting in a superfine plating structure. If the cooling is carried out in a more drastic manner, dendrites form as the hardened structure of the plating alloy. The process may entail direct cooling by a water spray, steam or a water flow immediately after the plated steel wire is drawn out from the plating bath, to harden the plating alloy.

For cooling of the plated steel wire, it is necessary to initiate the cooling while the plating is still in a molten state. If hardening occurs as a result of air cooling, each of the phases will grow during the hardening to form a coarse structure. The initial cooling temperature must therefore be above the melting point of the plating alloy. Also, contact of the cooling water with the high-temperature molten plating with low viscosity will roughen the plating surface, and therefore the upper limit for the initial cooling temperature is 20° C. above the melting point of the plating alloy.

The component composition of the plated steel wire comprises, in terms of weight percentage, C: 0.02–0.25%, Si: ≦1%, Mn: ≦0.6%, P: ≦0.04% and S: ≦0.04%.

C is the element that determines the strength of the steel, and in order to achieve the strength of an ordinary plated steel wire it must be added to at least 0.02%. On the other hand, if added at greater than 0.25% the strength will be too high, such that when it is used in a gabion or the like it will not be bendable when worked by hand; the upper limit is therefore 0.25%.

Si has the effect of improving the plating.adhesion while also increasing the strength. The strength becomes too high if the Si content is greater than 1%, and therefore the upper limit is 1%.

Mn has the effect of increasing the toughness of the steel while also increasing the strength. The strength becomes too high if the Mn content is greater than 0.6%, and therefore the upper limit is 0.6%.

P and S can cause stiffening of the steel, and both are therefore limited to no greater than 0.04%.

The surface of a molten zinc-plated steel wire or a molten zinc alloy-plated steel wire obtained according to the invention may be coated with at least one type of polymer compound selected from the group consisting of vinyl chloride, polyethylene, polyurethane and fluorine resins, in order to further enhance the corrosion resistance.

EXAMPLES 4-mm diameter steel wires, each comprising a pure Zn plating coated on the surface of a JIS G 3505 SWRM6 steel wire material, were coated with Zn—Al—Mg-based zinc alloy platings under the conditions shown in Table 1, and evaluated. For comparison, wires with different plating compositions, Fe—Zn alloy layer structures and plating structures were evaluated in the same manner.

The plating structure of each was observed by EPMA after polishing the cross-section of the plated steel wire. Analysis of the composition of the alloy layer was carried out by quantitative analysis with a beam diameter of 2 $\mu$m.

The corrosion resistance was evaluated as the corrosion loss per unit area due to corrosion of the plating, based on the difference in weight before and after a continuous salt spray test for 250 hours. A measurement of 20 g/m$^2$ or less was judged as acceptable for the test.

The workability was evaluated by winding the manufactured plated steel wire onto a 6 mm-diameter steel wire six times, visually observing its surface, and determining the presence or absence of cracks. After evaluation of the cracks, cellophane tape was pressed onto the sample and then peeled off, and the presence or absence of peeling of the plating was observed and evaluated. A limit of one crack and no peeling was judged as acceptable for this test.

Table 1 shows the relationship between the composition and thickness of the plating structure and alloy layer, the thickness, composition and β phase volume fraction of the plating outer layer, the corrosion resistance (corrosion loss), the workability (evaluation of the winding test) and the plating bath dross production.

The invention examples all exhibited satisfactory corrosion resistance and workability, and the dross production was also minimal. Comparative Examples 1–5 had plating alloy component compositions that were outside of the ranges of the component compositions specified by the present invention. Comparative Examples 1 and 2 had Mg or Al contents below the lower limits specified by the invention, and the corrosion resistance was inferior. Comparative Examples 3–5 had Mg or Al contents above the upper limits specified by the invention, and the workability was inferior and the plating bath dross production was greater, creating a hindrance to operation. Comparative Examples 6 and 7 had plating alloy layer thicknesses that were outside of the range specified by the invention, and this resulted in inferior workability. Comparative Examples 8–10 had β phases in the plating structure that were outside of the range specified by the invention, and the corrosion resistance was inferior.

Table 2 shows the relationship between the plating immersion time, the cooling method and initial cooling temperature for the molten zinc alloy plating in the second stage, the corrosion resistance and the workability, for a composition of Zn-10% Al-3% Mg. The samples whose plating conditions were within the ranges specified by the invention exhibited satisfactory results.

TABLE 1

| | Plating composition | | | | | Alloy layer | | | Plating outer layer | | | | Winding test | | |
|---|---|---|---|---|---|---|---|---|---|---|---|---|---|---|---|
| | Al % | Mg % | Si % | Na % | Ti % | Al % | Mg % | Thickness $\mu$m | Thickness $\mu$m | Structure | β phase volume fraction % | Corrosion loss g/m$^2$ | Cracking | Peeling | Plating bath dross production |
| Inv. Exs. | | | | | | | | | | | | | | | |
| 1 | 4 | 3.0 | | | | 20 | 3.7 | 18 | 30 | α/β/3-component eutectic crystals | 9 | 15 | ○ | ○ | ○ |
| 2 | 19 | 1.2 | | | | 27 | 1.6 | 3 | 41 | α/β/3-component eutectic crystals | 18 | 14 | ○ | ○ | ○ |
| 3 | 10 | 0.8 | | | | 22 | 1.2 | 11 | 62 | α/β/3-component eutectic crystals | 16 | 13 | ○ | ○ | ○ |
| 4 | 11 | 4.9 | | | | 22 | 4.7 | 16 | 59 | α/β/3-component eutectic crystals | 17 | 12 | ○ | ○ | ○ |
| 5 | 10 | 1.0 | | | | 23 | 1.3 | 12 | 75 | α/β/3-component eutectic crystals | 13 | 11 | ○ | ○ | ○ |
| 6 | 10 | 2.9 | | | | 21 | 3.6 | 18 | 49 | α/β/3-component eutectic crystals | 13 | 13 | ○ | ○ | ○ |
| 7 | 11 | 1.1 | | | | 24 | 1.4 | 13 | 53 | α/β/3-component eutectic crystals | 11 | 11 | ○ | ○ | ○ |
| 8 | 11 | 3.1 | | | | 26 | 3.5 | 17 | 22 | α/β/3-component eutectic crystals | 12 | 13 | ○ | ○ | ○ |
| 9 | 10 | 2.9 | | | | 22 | 3.4 | 15 | 21 | dendritic | — | 14 | ○ | ○ | ○ |
| 10 | 11 | 1.2 | | | | 24 | 1.8 | 2 | 11 | dendritic | — | 14 | ○ | ○ | ○ |
| 11 | 10 | 1.2 | 1.3 | | | 23 | 1.6 | 15 | 59 | α/β/3-component eutectic crystals | 12 | 12 | ○ | ○ | ○ |
| 12 | 10 | 3.1 | 0.8 | | | 21 | 3.8 | 16 | 31 | dendritic | — | 13 | ○ | ○ | ○ |
| 13 | 8 | 4.5 | | 0.008 | | 21 | 5.6 | 13 | 48 | α/β/3-component eutectic crystals | 13 | 14 | ○ | ○ | ○ |
| 14 | 14 | 4.4 | | 0.099 | | 26 | 4.8 | 18 | 28 | dendritic | — | 16 | ○ | ○ | ○ |
| 15 | 16 | 2.3 | | | 0.012 | 28 | 2.6 | 16 | 31 | dendritic | — | 17 | ○ | ○ | ○ |

TABLE 1-continued

| | Plating composition | | | | | Alloy layer | | | Plating outer layer | | | | | | |
|---|---|---|---|---|---|---|---|---|---|---|---|---|---|---|---|
| | Al % | Mg % | Si % | Na % | Ti % | Al % | Mg % | Thickness μm | Thickness μm | Structure | β phase volume fraction % | Corrosion loss g/m² | Winding test: Cracking | Winding test: Peeling | Plating bath dross production |
| 16 | 19 | 1.0 | | | 0.040 | 30 | 1.1 | 20 | 15 | α/β/3-component eutectic crystals | 19 | 13 | ○ | ○ | ○ |
| Comp. Exs. | | | | | | | | | | | | | | | |
| 1 | 5 | 0.3 | | | | 18 | 0.5 | 15 | 20 | α/β/3-component eutectic crystals | 19 | x 45 | ○ | ○ | ○ |
| 2 | 2 | 1.1 | | | | 16 | 1.6 | 18 | 10 | α/β/3-component eutectic crystals | 18 | x 42 | ○ | ○ | ○ |
| 3 | 7 | 6.0 | | | | 24 | 5.3 | 13 | 11 | α/β/3-component eutectic crystals | 19 | 19 | x | x | x |
| 4 | 25 | 3.0 | | | | 23 | 3.4 | 12 | 30 | α/β/3-component eutectic crystals | 16 | 15 | x | x | x |
| 5 | 18 | 6.0 | | | | 21 | 5.6 | 18 | 10 | dendritic | — | 12 | x | x | x |
| 6 | 11 | 0.9 | | | | 21 | 1.2 | x31 | 15 | α/β/3-component eutectic crystals | 17 | 14 | x | x | ○ |
| 7 | 10 | 2.3 | | | | 26 | 3.1 | x25 | 60 | dendritic | — | 13 | x | x | ○ |
| 8 | 8 | 0.9 | | | | 12 | 1.1 | 18 | 8 | α/β/3-component eutectic crystals | x 23 | x 46 | ○ | ○ | ○ |
| 9 | 13 | 2.1 | | | | 13 | 2.8 | 17 | 10 | α/β/3-component eutectic crystals | x 26 | x 62 | ○ | ○ | ○ |
| 10 | 10 | 3.2 | | | | 15 | 3.4 | 23 | 20 | α/β/3-component eutectic crystals | x 35 | x 38 | ○ | ○ | ○ |

TABLE 2

| | | Plating immersion time (sec): First stage | Plating immersion time (sec): Second stage | Molten zinc alloy plating in second stage: Cooling method | Molten zinc alloy plating in second stage: Initial cooling time | Corrosion loss | Winding test |
|---|---|---|---|---|---|---|---|
| Invention Exs. | 1 | 15 | 18 | water spray | melting point + 1° C. | ○ | ○ |
| | 2 | 11 | 19 | steam spray | melting point + 1° C. | ○ | ○ |
| | 3 | 19 | 11 | direct water flow | melting point + 10° C. | ○ | ○ |
| | 4 | 18 | 10 | steam spray | melting point + 10° C. | ○ | ○ |
| | 5 | 8 | 19 | water spray | melting point + 11° C. | ○ | ○ |
| | 6 | 6 | 18 | direct water flow | melting point + 11° C. | ○ | ○ |
| | 7 | 15 | 10 | steam spray | melting point + 19° C. | ○ | ○ |
| | 8 | 18 | 10 | direct water flow | melting point + 19° C. | ○ | ○ |
| | 9 | 9 | 19 | direct water flow | melting point + 19° C. | ○ | ○ |
| | 10 | 18 | 18 | steam atomizing | melting point + 19° C. | ○ | ○ |
| Comp. Exs. | 1 | 15 | 25 | direct water flow | melting point + 10° C. | ○ | x |
| | 2 | 28 | 10 | steam spray | melting point + 11° C. | ○ | x |
| | 3 | 16 | 12 | cooling in air | no cooling | x | x |
| | 4 | 13 | 16 | cooling in air | no cooling | x | x |
| | 5 | 12 | 15 | water spray | melting point + 35° C. | x | ○ |
| | 6 | 15 | 12 | steam spray | melting point + 28° C. | x | ○ |
| | 7 | 16 | 11 | water spray | melting point − 10° C. | x | ○ |
| | 8 | 18 | 9 | steam spray | melting point − 10° C. | x | ○ |

Industrial Applicability

As explained above, according to the present invention, it is possible to obtain zinc alloy-plated steel wires with high corrosion resistance and excellent workability.

Incidentally, although the present invention relates particularly to wire materials, it is a technique that may be adequately applied to steel pipes and steel structures as well, and it is therefore expected to offer a major contribution to industrial technology.

What is claimed is:

1. A plated steel wire with high corrosion resistance and excellent workability, the plated steel wire being characterized in that the average composition of the plating alloy contains, in terms of weight percentage, Al: 4–20%, Mg: 0.8–5% and the remainder Zn, and in that an Fe—Zn alloy layer, containing Al: ≦4%, Mg: ≦1%, of no greater than 20 μm thickness is present at the plating-base metal interface, and the structure of the plating alloy layer on the outer side of said Fe—Zn alloy layer includes an ax phase composed mainly of Al—Zn, a β phase comprising a Zn monophase or an Mg—Zn alloy phase, and a Zn/Al/Zn—Mg three component eutectic phase.

2. A plated steel wire with high corrosion resistance and excellent workability according to claim 1, wherein the plating alloy layer further contains, in terms of weight percentage, one or more of Si: ≦2%, Na: 0.001–0.1% and Ti: 0.01–0.1%.

3. A plated steel wire with high corrosion resistance and excellent workability according to claim 1, wherein the volume fraction of the β phase is no greater than 20%.

4. A plated steel wire with high corrosion resistance and excellent workability according to claim 1, wherein the component composition of said plated steel wire comprises, in terms of weight percentage, C: 0.02–0.25%, Si: ≦1%, Mn: ≦0.6%, P: ≦0.04% and S: ≦0.04%.

5. A process for the manufacture of a plated steel wire with high corrosion resistance and excellent workability, characterized in that the process for manufacture of a plated steel wire comprises the steps of: coating the steel wire with a molten zinc plating composed mainly of zinc as the first stage, and then coating it with a molten zinc alloy plating having the average composition of, in terms of weight percentage, Al: 4–20% and Mg: 0.8–5%, and the remainder Zn, and drawing the plated wire from the plating bath, purging it in nitrogen gas, and directly cooling by a water spray, steam or a water flow immediately after plating the steel wire.

6. A process for manufacture of a plated steel wire with high corrosion resistance and excellent workability according to claim 5, further comprising the steps of: immersing the steel wire in the molten zinc plating bath within 20 seconds in the first stage, and then immersing the steel wire in the molten zinc alloy plating bath within 20 seconds in the second stage.

7. A process for manufacture of a plated steel wire with high corrosion resistance and excellent workability according to claim 5 or 6, further comprising the steps of: cooling the plated steel wire at an initial cooling temperature in a temperature range from a melting point of the plating alloy to 20° C. above said melting point.

8. A process for manufacture of a plated steel wire with high corrosion resistance and excellent workability according to claim 5 or 6, characterized in that the component composition of said steel wire comprises, in terms of weight percentage, C: 0.02–0.25%, Si: ≦1%, Mn: ≦0.6%, P: ≦0.04% and S: ≦0.04%.

* * * * *

UNITED STATES PATENT AND TRADEMARK OFFICE

CERTIFICATE OF CORRECTION

PATENT NO. : 6,579,615 B1 
DATED : June 17, 2003
INVENTOR(S) : Satoshi Sugimaru et al.

It is certified that error appears in the above-identified patent and that said Letters Patent is hereby corrected as shown below:

Column 9,
Line 65, change "… Al: ≦ 4%, Mg: ≦ 1%…" to -- … Al: ≧ 4%, Mg: ≧ 1%… -- .

Signed and Sealed this

Twenty-fifth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,579,615 B1
DATED : June 17, 2003
INVENTOR(S) : Satoshi Sugimaru et al.

It is certified that error appears in the above-identified patent and that said Letters Patent is hereby corrected as shown below:

Column 10,
Line 49, change "… ax…" to -- … α… --

Signed and Sealed this

Twenty-ninth Day of June, 2004

JON W. DUDAS
*Acting Director of the United States Patent and Trademark Office*